US006758417B2

(12) United States Patent
Buck

(10) Patent No.: US 6,758,417 B2
(45) Date of Patent: Jul. 6, 2004

(54) INJECTOR FOR A COMMON RAIL FUEL INJECTION SYSTEM, WITH SHAPING OF THE INJECTION COURSE

(75) Inventor: Rainer Buck, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 4 days.

(21) Appl. No.: 10/303,704

(22) Filed: Nov. 26, 2002

(65) Prior Publication Data

US 2003/0111548 A1 Jun. 19, 2003

(30) Foreign Application Priority Data

Nov. 27, 2001 (DE) ..... 101 58 028

(51) Int. Cl.[7] ..... F02M 59/00

(52) U.S. Cl. ..... 239/533.2; 239/88; 239/91; 239/585.1; 239/96

(58) Field of Search ..... 239/533.2, 533.3, 239/533.4, 533.8, 533.9, 96, 88, 89, 90, 91, 92, 585.1, 585.2, 585.4, 585.5; 251/129.01; 123/506

(56) References Cited

U.S. PATENT DOCUMENTS 4,625,700 A * 12/1986 Elsbett et al. ..... 123/500
4,976,245 A * 12/1990 Takahashi et al. ..... 123/506
5,011,082 A * 4/1991 Ausiello et al. ..... 239/585.1
6,685,160 B2 * 2/2004 Shinogle et al. ..... 251/129.1

* cited by examiner

*Primary Examiner*—Dinh Q. Nguyen
(74) *Attorney, Agent, or Firm*—Ronald E. Greigg

(57) ABSTRACT

A common rail injector is proposed which offers great freedom in designing the course of the preinjection main injection and of the injection pressure. Moreover, it offers improved security against leaks into the combustion chamber, caused for instance by a leaking nozzle needle valve seat.

21 Claims, 2 Drawing Sheets

INJECTOR FOR A COMMON RAIL FUEL INJECTION SYSTEM, WITH SHAPING OF THE INJECTION COURSE

BACKGROUND OF THE INVENTION

1. Field of the Invention

The invention is directed to an improved injector for a common rail fuel injection system for internal combustion engines, having an injection nozzle at has a nozzle needle and having a control chamber, subdivided into three portions by a control plunger, wherein the first portion and second portion communicate hydraulically via an inlet throttle disposed in the control plunger, and the second portion is hydraulically in communication with a high-pressure connection and the third portion is hydraulically in communication with an inlet conduit to the nozzle needle, and the control plunger has two grooves, and between the grooves the control plunger is embodied as a slide and with a control edge of the guide bore, when the injection nozzle is closed, effects an extensive hydraulic separation between the high-pressure connection and the inlet conduit to the nozzle needle, and the stroke of the nozzle needle and the stroke of the control plunger are coupled with one another.

2. Description of the Prior Art

An injector of the type described above is described in German Patent Disclosure DE 199 63 920 A1.

OBJECT AND SUMMARY OF THE INVENTION

The object of the invention is to further improve the injector known from German Patent Disclosure DE 199 63 920 A1, and in particular to expand the design possibilities for the course of the preinjection, main injection, and optionally post injection, such that overall, improved fuel consumption and emissions of the engine are obtained.

In an injector for a common rail fuel injection system for internal combustion engines, having an injection nozzle that has a nozzle needle, and having a control chamber subdivided into three portions by a control plunger, wherein the first portion and second portion communicate hydraulically via an inlet throttle disposed in the control plunger, and the second portion is hydraulically in communication with a high-pressure connection and the third portion is hydraulically in communication with an inlet conduit to the nozzle needle, and the control plunger has two grooves, and between the grooves the control plunger is embodied as a slide and with a control edge of the guide bore, when the injection nozzle is closed, effects an extensive hydraulic separation between the high-pressure connection and the inlet conduit to the nozzle needle, and the stroke of the nozzle needle and the stroke of the control plunger are coupled with one another, this object is attained in that a hydraulic connection that is closable by a multi-port directional-control valve is provided between the high-pressure connection, or the second portion, and the inlet conduit to the nozzle needle.

It has been found that by means of the additional hydraulic connection of the invention, which can be opened and closed by a multi-port directional-control valve, the injection into the combustion chamber can be accomplished in a simple way with the full rail pressure, without having to accept disadvantages in the shaping of the injection course of the preinjection and/or at the onset of the main injection. The requirements in terms of tightness and speed made of the multi-port directional-control valve required for this are not stringent, and so the costs for this multi-port directional-control valve are low. With the aid of the hydraulic connection of the invention, a postinjection at high injection pressure can also be accomplished, which has proved to be advantageous in reducing so-called black smoke in the exhaust gases.

In a variant of the invention, it is provided that the control plunger is disposed axially displaceably in a guide bore; that the nozzle needle is disposed axially displaceably in a bore extending coaxially to the guide bore; and that the coupling of the control plunger and nozzle needle is effected via a valve plunger. Because of the coaxial disposition of the control plunger and nozzle needle, the coupling forces can be transmitted directly and in a simple way. If necessary, the distance between the control plunger and the nozzle needle can be bridged with the aid of a valve plunger.

In a further expansion of the invention, the valve plunger and the control plunger, or the nozzle needle and the control plunger, are embodied integrally, thus reducing the number of components and avoiding errors of alignment.

For the purposes of the invention, it is advantageous if the multi-port directional-control valve is embodied as an electrically actuated 2/2-port directional-control valve, and in particular as an electrically actuated slide valve, since such valves are adequate in terms of their response and tightness and are simple to produce.

The reliability of the injector is enhanced if the multi-port directional-control valve is closed when without current.

In another variant, it is provided that a closing spring that is braced against the housing of the injector and against the nozzle needle is present, so that even in the absence of fuel pressure, the injector will always be securely closed. Moreover, the closing spring can contribute to the automatic re-closure, reinforcing the hydraulic closing force, once the magnet valve has been triggered a single time.

In a further feature of the invention, the hydraulic separation of the high-pressure connection and the inlet conduit to the nozzle needle is defined structurally by means of the overlap of the slide and the control plunger and by means of the fit between the slide and the guide bore, so that in tuning the injector, a further degree of freedom can be exploited.

Finally, it can be provided that an auxiliary spring acting on the control plunger is present, and/or that the inlet conduit to the nozzle needle, in conjunction with the fuel located in it, serves as a pressure reservoir, so that particularly in the main injection, it is assured that the control plunger will execute such a long stroke that there is no longer any overlap between the slide and the control edge, and thus the injection nozzle of the injector is subjected to the full pressure of the fuel. This enables fast opening of the injection nozzle, and a large quantity of fuel can be injected quickly.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
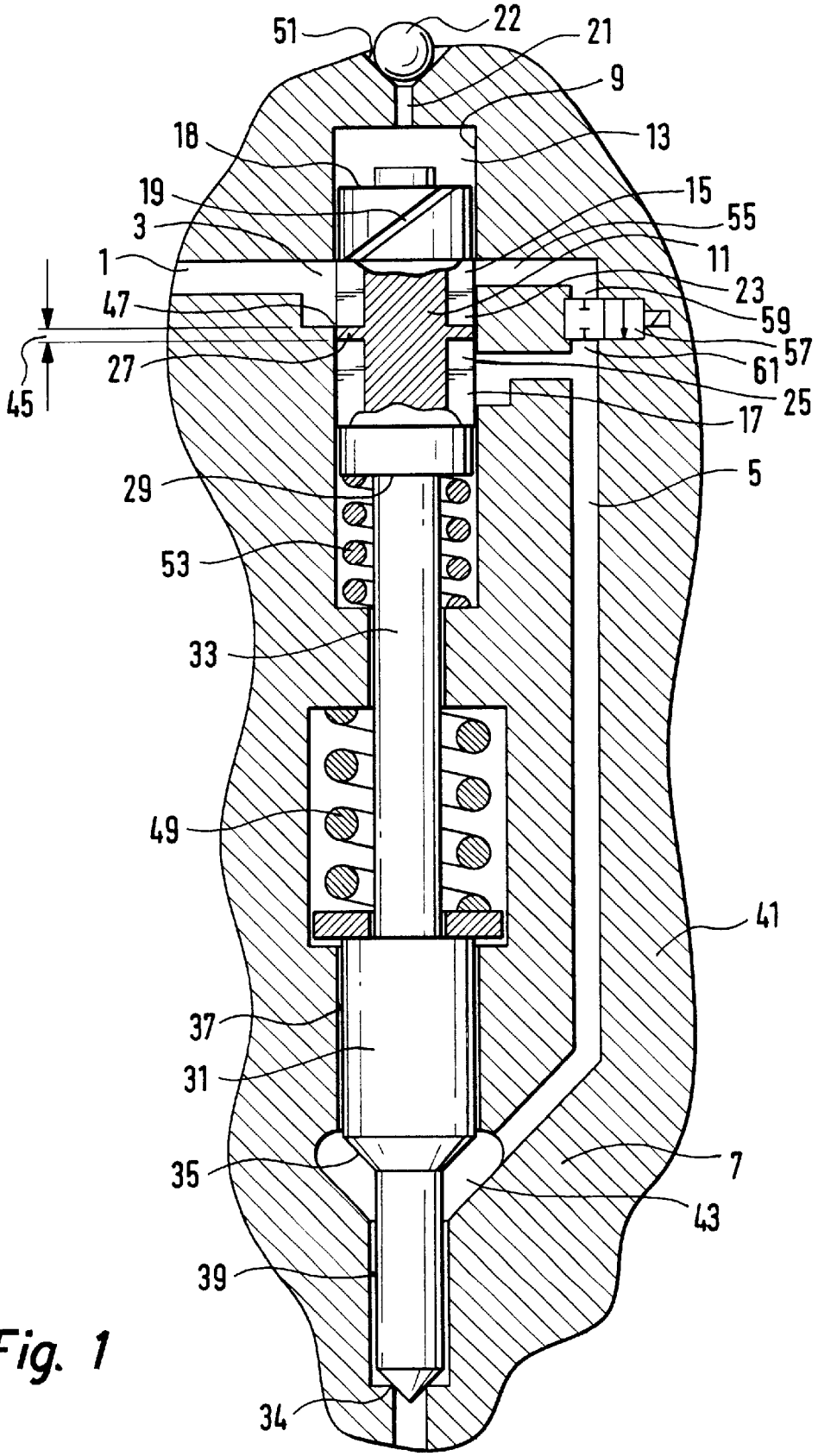
FIG. 1 is a cross section through an injector of the invention, with a closed magnet valve.

In FIG. 1, an injector of the invention is schematically shown. A high-pressure connection 1 supplies a control chamber 3 with fuel, not shown in FIGS. 1 and 2. Via the control chamber 3 and an inlet conduit 5 to the nozzle needle 31, an injection nozzle 7 is also supplied with fuel.

The control chamber 3 is bounded radially by a guide bore 9. An axially displaceable control plunger 11 is present in the guide bore 9. The control plunger divides the control chamber 3 into three portions 13, 15 and 17.

The first portion 13 of the control chamber 3 is bounded axially by a first end face 18 of the control plunger 11. The first portion 13 of the control chamber 3 also communicates hydraulically with the second portion 15 of the control chamber 3 via an inlet throttle 19. The inlet throttle 19 may be embodied as a groove or as a bore. Via an outlet throttle 21, which can be opened by a ball 22 controlled by a magnet valve, not shown, the first portion 13 communicates with a fuel return, also not shown.

The control plunger 11 has two grooves 23, 25, which radially define the second portion 15 and the third portion 17 of the control chamber 3. A slide 27 is disposed between the grooves 23, 25.

The second end face 29 of the control plunger 11 is adjoined by a valve plunger 33 that acts on the nozzle needle 31 of the injection nozzle 7. The nozzle needle 31 prevents the fuel, which is under pressure, from flowing into the combustion chamber, not shown, between injections. This is achieved by providing that the nozzle needle 31 is pressed into a nozzle needle seat 34 and seals off the inlet conduit to the nozzle needle 5 from the combustion chamber.

The nozzle needle 31 has a cross-sectional change 35 from a larger diameter 37 to a smaller diameter 39. With its larger diameter 37, the nozzle needle 31 is guided in a housing 41 of the injector. The cross-sectional change 35 defines a pressure chamber 43 of the injection nozzle 7.

In the position shown in FIG. 1, the slide 27 disconnects the third portion 17 of the control chamber 3, and thus also the inlet conduit 5 leading from the third portion 17 of the control chamber 3 to the nozzle needle, from the high-pressure connection 1. The overlap 45 of the slide 27 and a control edge 47 of the guide bore 9, and the fit between the slide 27 and the guide bore 9, are selected such that in this position of the slide 27 as well, a certain leakage occurs between injections, and thus the same pressure prevails in the pressure chamber 43 as in the high-pressure connection 1.

When the outlet throttle 21 is closed, the same pressure prevails throughout the injector. Because the first end face 18 of the control plunger 11 is larger than the annular face of the cross-sectional change 35, the hydraulic force acting on the first end face 18 of the control plunger 11 is greater than the hydraulic force acting on the cross-sectional change 35, and the nozzle needle 31 is pressed into the nozzle needle seat 34. When the high-pressure pump, not shown, of the fuel injection system is not driven, because the engine is stopped, then a closing spring 49 acting on the nozzle needle 31 presses the nozzle needle 31 into the nozzle needle seat 34 and thus closes the outlet nozzle of the injector 7. The closing spring 49 is braced against the housing 41 of the injector.

When the outlet throttle 21 is opened, which happens when the magnet valve is triggered and the ball 22 lifts from a ball seat 51, the pressure in the first portion 13 of the control chamber 3 drops, since the inlet throttle 19 prevents a complete pressure equalization between the inlet conduit to the nozzle needle 5 and first portion 13 of the valve control chamber 3. As a consequence, the hydraulic force acting on the first end face 18 also drops. As soon as this hydraulic force is less than the hydraulic force acting on the cross-sectional change 35, the nozzle needle 31 lifts from the nozzle needle seat 34 and thus opens the injection nozzle 7, so that fuel is injected into the combustion chamber. The opening speed of the nozzle needle 31 is determined, among other factors, by the difference in flow between the inlet throttle 19 and the outlet throttle 21.

As long as the stroke of the control plunger 11 is shorter than the overlap 45 between the slide 27 and the control edge 47, a pressure reduction takes place in the region of the slide 27, from the second portion 15 to the third portion 17. As a consequence, the injection into the combustion chamber takes place at reduced injection pressure.

By means of a suitable design of the injector, a preinjection at slight injection pressure and with a slight injection quantity can be brought about as well. To achieve this, the force of the closing spring 49 and the hydraulic force acting on the first end face 18 must be greater than the hydraulic force acting on the cross-sectional change 35. Because of the throttling between the slide 27 and the control edge 47, the pressure in the pressure chamber 43 can drop so far that the aforementioned condition occurs. This creates additional possibilities in designing the course of the main injection and the preinjection. Moreover, given a suitable hydraulic design, a preinjection with a one-time triggering of the magnet valve, not shown, can be achieved.

Figure 2:
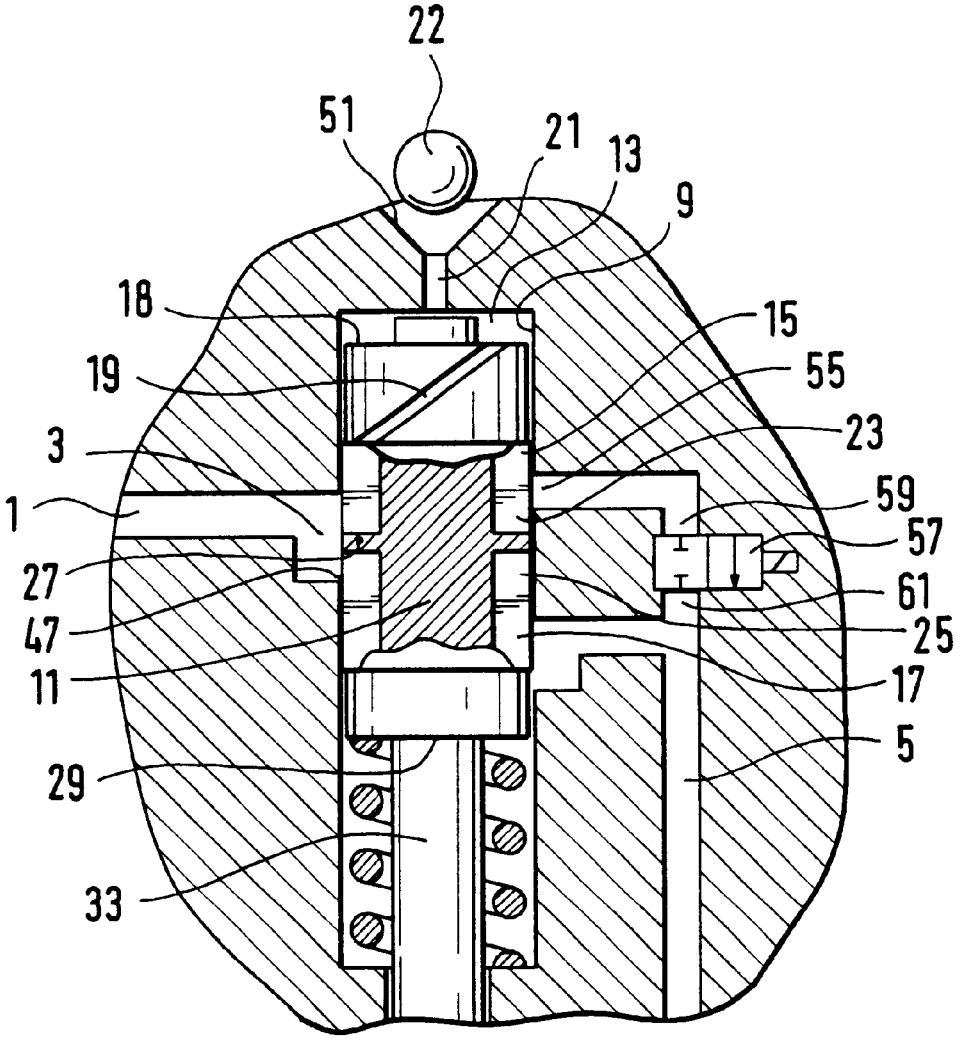
FIG. 2 shows the control chamber of an injector of the invention, with the magnet valve open.

To enable adapting the course of the injection pressure still further to the requirements of the engine, a separate hydraulic connection 55 is provided between the second portion 15 and the inlet conduit 5 to the nozzle needle. Alternatively, the hydraulic connection 55 can also cause the high-pressure connection 1 to directly communicate (not shown) with the inlet conduit 5 to the nozzle needle. An electrically actuated 2/2-port directional-control valve 57 is disposed in the hydraulic connection 55. If the 2/2-port directional-control valve 57 is closed, as is shown in FIGS. 1 and 2, then the hydraulic connection 55 has no influence on the behavior of the injector. However, as soon as the 2/2-port directional-control valve 57 is opened, the inlet conduit 5 to the nozzle needle is subjected to the full rail pressure, which leads to a rapid opening of the nozzle needle and a fine atomization of the fuel injected into the combustion chamber (not shown). By means of the hydraulic connection 55 of the invention and the 2/2-port directional-control valve 57 of the invention, a device that is to be actuated independently of the control plunger 11 is thus available for subjecting the cross-sectional change 35 to the full rail pressure. This means that an injection can be begun with a low injection pressure, and then the maximum injection pressure is immediately made available by the opening of the 2/2-port directional-control valve 57.

The resultant additional degrees of freedom in shaping the injection course in terms of the injection pressure and the injected fuel quantity lead to improved emissions and consumption of the engine. For instance, so-called black smoke can be reduced by means of a postinjection at high injection pressure, controlled by the 2/2-port directional-control valve 57.

The demands to be made of the 2/2-port directional-control valve 57 in terms of tightness and switching speed are not stringent, since when the nozzle needle 31 is closed, rail pressure prevails at both the inlet 59 and the outlet 61 of the 2/2-port directional-control valve 57.

If the stroke of the control plunger 11 is longer than the overlap 45 between the slide 27 and the control edge 47, then the third portion 17 of the control chamber 3 communicates directly with the high-pressure connection 1, and no pressure reduction is effected by the slide 27 and the control edge 47. This state is shown in FIG. 2. No attempt has been made to show the complete injector in FIG. 2; instead, see FIG. 1.

In the position of the control plunger 11 shown in FIG. 2, the main injection takes place. To assure that the control plunger 11 reaches this position, the volume of the inlet conduit 5 to the nozzle needle, and its elasticity, should be selected appropriately. Given a suitable choice of these parameters and taking the compressibility of the fuel into account, an adequate quantity of fuel is stored in the inlet conduit to prevent an excessive drop in the pressure in the pressure chamber 43 at the onset of the injection. If the pressure in the pressure chamber 43 drops too sharply, the injection nozzle 7 closes, which is not wanted during the main injection. In addition or alternatively, an auxiliary spring 53 can also be provided. The auxiliary spring 53 acts on the second end face 29 of the control plunger 11 and reinforces the opening of the injection nozzle 7.

Another advantage of this injector is that the overlap 45 between the slide 27 and the control edge 47, when the injection nozzle 7 is closed, sharply reduces leaks between the nozzle needle 31 and the nozzle needle seat 34 caused for instance by small chips or the like. This provides enhanced security against an erroneous permanent fuel flow into the combustion chamber (internal leakage).

To terminate the injection, the outlet throttle 21 is closed by the ball 22 in a known manner not explained in detail here. Because of the closure of the outlet throttle 21, virtually the full pressure prevailing in the high-pressure connection 1 builds up again in the first portion 13 of the valve control chamber 3 via the inlet throttle 19. This pressure, via the first end face 18 of the control plunger 11 and via the valve plunger 33 exerts a hydraulic force on the nozzle needle 31. As soon as this hydraulic force exceeds the hydraulic force acting on the cross-sectional change 35, the nozzle needle 31 closes. Because the first end face 18 of the control plunger 11 is markedly larger in comparison to the annular surface area of the cross-sectional change 35, the closing motion takes place very quickly and with great force.

The indirect triggering of the nozzle needle 31 via a hydraulic force booster system is necessary since the forces required for fast opening of the nozzle needle 31 cannot be generated directly by the magnet valve. The so-called "control quantity" required in addition to the fuel quantity injected into the combustion chamber reaches the fuel return via the inlet throttle 19, control chamber 3, and outlet throttle 21. In addition to the control quantity, leakage also occurs at the nozzle needle guide. The control and leakage quantities can amount to as much as 50 $mm^3$ per stroke. They are likewise carried away to the fuel return, not shown, again via the outlet throttle 21.

All the characteristics described above and shown in the drawing may be essential to the invention both individually and in arbitrary combination with one another.

The foregoing relates to a preferred exemplary embodiment of the invention, it being understood that other variants and embodiments thereof are possible within the spirit and scope of the invention, the latter being defined by the appended claims.

I claim:

1. An injector for a common rail fuel injection system for internal combustion engines, comprising, an injection nozzle (7) that has a nozzle needle (31), a control chamber (3), subdivided into first, second and third portions (13, 15, 17) by a control plunger (11), the first portion (13) and second portion (15) communicating hydraulically via an inlet throttle (19) disposed in the control plunger (11), the second portion (15) hydraulically communicating with a high-pressure connection (1), and the third portion (17) hydraulically communicating with an inlet conduit (5) to the nozzle needle, the control plunger (11) having two grooves (23, 25) separated by a slide (27) embodied on the control plunger (11), the slide cooperating with a control edge (47) of a guide bore (9), when the injection nozzle (7) is closed, to effect an extensive hydraulic separation between the high-pressure connection (1) and the inlet conduit (5) to the nozzle needle, the stroke of the nozzle needle (31) and the stroke of the control plunger (11) being coupled with one another, a hydraulic connection (55) between the high-pressure connection (1), or the second portion (15), and the inlet conduit (5) to the nozzle needle, and, a multi-port directional control valve 57 operable to close the hydraulic connection (55).

2. The injector of claim 1 wherein the control plunger (11) is disposed axially displaceably in the guide bore (9); wherein the nozzle needle (31) is disposed axially displaceably in a bore extending coaxially to the guide bore (9); and wherein a coupling of the control plunger (11) and nozzle needle (31) is effected via a valve plunger (33).

3. The injector of claim 2 wherein the valve plunger (33) and the control plunger (11) and/or the nozzle needle (31) and the control plunger (11) are embodied integrally.

4. The injector of claim 3 wherein the multi-port directional-control valve (57) is embodied as an electrically actuated 2/2-port directional-control valve, and in particular as an electrically actuated slide valve.

5. The injector of claim 3 wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).

6. The injector of claim 3 further comprising a closing spring (49) that is braced against a housing (41) of the injector and against the nozzle needle (31) is present.

7. The injector of claim 2 wherein the multi-port directional-control valve (57) is embodied as an electrically actuated 2/2-port directional-control valve, and in particular as an electrically actuated slide valve.

8. The injector of claim 2 wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).

9. The injector of claim 2 further comprising a closing spring (49) that is braced against a housing (41) of the injector and against the nozzle needle (31) is present.

10. The injector of claim 2 further comprising an auxiliary spring (53) acting on the control plunger (11).

11. The injector of claim 1 wherein the multi-port directional-control valve (57) is embodied as an electrically actuated 2/2-port directional-control valve, and in particular as an electrically actuated slide valve.

12. The injector of claim 11 wherein the multi-port directional-control valve (57) is closed when without current.

13. The injector of claim 12 wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).

14. The injector of claim 13 further comprising an auxiliary spring (53) acting on the control plunger (11).

15. The injector of claim 11 wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).

16. The injector of claim 11 further comprising a closing spring (49) that is braced against the housing (41) of the injector and against the nozzle needle (31) is present.

17. The injector of claim 1 wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).

18. The injector of claim 17 further comprising an auxiliary spring (53) acting on the control plunger (11).

19. The injector of claim 1 further comprising a closing spring (49) that is braced against a housing (41) of the injector and against the nozzle needle (31) is present.

20. The injector of claim 1 further comprising an auxiliary spring (53) acting on the control plunger (11).

21. The injector of claim 1 wherein the inlet conduit (5) to the nozzle needle (31), in conjunction with the fuel located in it, serves as a pressure reservoir.

* * * * *

UNITED STATES PATENT AND TRADEMARK OFFICE

CERTIFICATE OF CORRECTION

PATENT NO. : 6,758,417 B2
DATED : July 6, 2004
INVENTOR(S) : Rainer Buck

It is certified that error appears in the above-identified patent and that said Letters Patent is hereby corrected as shown below:

Column 6,
Lines 31-67, please correct to read as follows:

4. The injector of claim 1, wherein the multi-port directional-control valve (57) is embodied as an electrically actuated 2/2-port directional-control valve, and in particular as an electrically actuated slide valve.
5. The injector of claim 2, wherein the multi-port directional-control valve (57) is embodied as an electrically actuated 2/2-port directional-control valve, and in particular as an electrically actuated slide valve.
6. The injector of claim 3, wherein the multi-port directional-control valve (57) is embodied as an electrically actuated 2/2-port directional-control valve, and in particular as an electrically actuated slide valve.
7. The injector of claim 4, wherein the multi-port directional-control valve (57) is closed when without current.
8. The injector of claim 1, wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).
9. The injector of claim 2, wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).
10. The injector of claim 3, wherein the hydraulic separation of the high-pressure connection (1) and the inlet 5 to the nozzle needle is defined structurally by means of an overlap (45) of the slide (27) and the control edge (47) and by means of the fit between the slide (27) and the guide bore (9).
11. The injector of claim 4, wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).
12. The injector of claim 7, wherein the hydraulic separation of the high-pressure connection (1) and the inlet conduit 5 to the nozzle needle is defined structurally by means of an overlap (45) of the slide (27) and the control edge (47) and by means of the fit between the slide (27) and the guide bore (9).
13. The injector of claim 1, further comprising a closing spring (49) that is braced against a housing (41)

Column 7,
Lines 1-17, please correct to read as follows:

of the injector and against the nozzle needle (31) is present.

14. The injector of claim 2, further comprising a closing spring (49) that is braced against a housing (41) of the injector and against the nozzle needle (31) is present.

15. The injector of claim 3, further comprising a closing spring (49) that is braced against a housing (41) of the injector and against the nozzle needle (31) is present.

16. The injector of claim 4, further comprising a closing spring (49) that is braced against a housing (41) of the injector and against the nozzle needle (31) is present.

17. The injector of claim 1, further comprising an auxiliary spring (53) acting on the control plunger (11).

UNITED STATES PATENT AND TRADEMARK OFFICE

CERTIFICATE OF CORRECTION

PATENT NO. : 6,758,417 B2
DATED : July 6, 2004
INVENTOR(S) : Rainer Buck

It is certified that error appears in the above-identified patent and that said Letters Patent is hereby corrected as shown below:

Column 8,
Lines 1-12, please correct to read as follows:

18. The injector of claim 2, further comprising an auxiliary spring (53) acting on the control plunger (11).

19. The injector of claim 8, further comprising an auxiliary spring (53) acting on the control plunger (11).

20. The injector of claim 12, further comprising an auxiliary spring (53) acting on the control plunger (11).

Signed and Sealed this

Seventh Day of September, 2004

JON W. DUDAS
*Director of the United States Patent and Trademark Office*